US005649854A

United States Patent [19]

Gill, Jr.

[11] Patent Number: 5,649,854

[45] Date of Patent: *Jul. 22, 1997

[54] POLISHING APPARATUS WITH INDEXING WAFER PROCESSING STATIONS

[76] Inventor: Gerald L. Gill, Jr., 9040 S. 47th Pl., Phoenix, Ariz. 85044

[ * ] Notice: The portion of the term of this patent subsequent to May 4, 2014, has been disclaimed.

[21] Appl. No.: 352,348

[22] Filed: Dec. 8, 1994

Related U.S. Application Data

[63] Continuation-in-part of Ser. No. 237,989, May 4, 1994, Pat. No. 5,562,524.

[51] Int. Cl.[6] ..... B24B 7/22

[52] U.S. Cl. ..... 451/290; 451/66

[58] Field of Search ..... 451/280, 287, 451/288, 289, 278, 282, 332, 333, 339, 914, 334, 290, 66

[56] References Cited

U.S. PATENT DOCUMENTS

| | | | |
|---|---|---|---|
| 3,849,944 | 11/1974 | Noll | 451/334 |
| 4,753,049 | 6/1988 | Mori | 451/287 |
| 5,140,774 | 8/1992 | Ohodera | 451/269 |
| 5,174,067 | 12/1992 | Hasegawa et al. | 451/339 |
| 5,333,413 | 8/1994 | Hashimoto | 451/290 |
| 5,361,545 | 11/1994 | Nakamura | 451/290 |

*Primary Examiner*—Robert A. Rose

*Attorney, Agent, or Firm*—Tod R. Nissle, P.C.

[57] ABSTRACT

Apparatus for polishing a side of a thin, flat wafer of a semiconductor material includes first and second polishing heads which each hold a wafer against a wetted polishing surface and which each rotate and oscillate its respective wafer over the polishing surface. When the first polishing head is moved away from the polishing surface to clean, eject, and replace its wafer, the second polishing head occupies the space over the polishing surface normally occupied by the first polishing head so that the polishing surface is used substantially continuously, and not intermittently.

10 Claims, 3 Drawing Sheets

POLISHING APPARATUS WITH INDEXING WAFER PROCESSING STATIONS

CROSS REFERENCE TO RELATED APPLICATIONS

This application is a continuation-in-part of U.S. application No. 08/237,989 filed May 4, 1994, now U.S. Pat. No. 5,562,524.

SUMMARY OF THE INVENTION

This invention relates to polishing apparatus.

More particularly, the invention relates to apparatus for polishing a side of a thin, flat wafer of a semiconductor material, the apparatus including a polishing head which holds the wafer against a wetted polishing surface and which rotates and oscillates the wafer over the polishing surface.

Apparatus for polishing thin, flat semiconductor wafers is well known in the art. See, for example, U.S. Pat. Nos. 4,193,226 to Gill, Jr. et al. and 4,811,522 to Gill, Jr. Such apparatus includes a polishing head which carries a circular semiconductor wafer and presses the wafer downwardly against a wetted polishing surface. The polishing head rotates and oscillates the wafer over the polishing surface. The polishing surface also rotates. The polishing head is forced downwardly toward the polishing surface by an air cylinder or other comparable mechanism. The downward force pressing the polishing head toward the polishing surface can be adjusted to be minimized or eliminated. The polishing head is mounted on an elongate pivoting carrier arm which can move the pressure head between several operative positions. In one operative position, the carrier arm positions a wafer mounted on the pressure head in contact with the polishing surface. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station can comprise a station for cleaning the wafer and/or pressure head; a wafer unload station; or, a wafer load station.

One particular disadvantage of prior art semiconductor polishing apparatus is the non-productive time incurred when the pressure head is removed from its position in the volumetric processing zone over the polishing surface and is positioned over one of the auxiliary wafer processing stations. Efficiency dictates that a wafer be in the processing zone continuously instead of only intermittently.

One prior art apparatus attempts to increase polishing efficiency by simultaneously polishing multiple wafers on a polishing pad. Each wafer is mounted on a polishing head. The polishing heads are positioned in a processing zone above the polishing surface while the wafers are polished. After the wafers are polished, the polishing heads are moved from a position over the polishing surface to load/unload stations to remove the polished wafers and mount new wafers on the polishing heads. The polishing heads are then moved back over the polishing surface to polish the new wafer. Since the polishing heads are not positioned over the polishing surface during the loading and unloading of wafers, such prior art apparatus does not provide continuous use of the processing zone above the polishing surface.

Accordingly, it would be highly desirable to provide improved apparatus for polishing a surface of a flat, semiconductor wafer.

Another object of the invention is to provide improved semiconductor wafer polishing apparatus which includes a polishing head for carrying a semiconductor wafer and rotating and oscillating the wafer under pressure over a polishing surface.

A further object of the invention is to provide improved semiconductor wafer polishing apparatus which substantially reduces the non-productive time during which the wafer polishing surface is not contacting a semiconductor wafer.

These and other, further and more specific objects and advantages of the invention will be apparent to those skilled in the art from the following detailed description thereof, taken in conjunction with the drawings, in which.

Briefly, in accordance with my invention, I provide apparatus for polishing thin wafers of a material. The apparatus includes a first frame; a first carrier pivotally mounted on the frame and including a distal end; a first pressure head mounted on the distal end of the carrier for carrying a first wafer and for maintaining the first wafer in contact with the first pressure head and against the polishing surface; a first processing station; and, a second station having a polishing surface. The carrier is movable between at least two operative positions, a first operative position with the pressure head positioned over the first processing station, and a second operative position. In the second operative position the first carrier is moved from the first operative position to the second operative position; the pressure head is positioned over the polishing surface; and, the pressure head and the distal end occupy a selected processing zone above the polishing surface. The apparatus also includes a second frame; a second carrier pivotally mounted on the second frame and having a distal end; a second pressure head mounted on the distal end of the second carrier for carrying a second wafer and for maintaining the second wafer in contact therewith and against the polishing surface; and, a third processing station. The second carrier is movable between at least two operative positions, a first operative position with the second pressure head positioned at the third station; and, a second operative position with the second carrier moved from the first operative position to the second operative position, with the second pressure head positioned over the polishing surface of the second station when the first carrier is in the first operative position, and with the second pressure head and the distal end of the second carrier occupying at least a portion of the processing zone. The second elongate carrier means is movable to the second operative position only when the first carrier is positioned in the second operative position of the first carrier with the first pressure head moved out of the processing zone.

Figure 1:
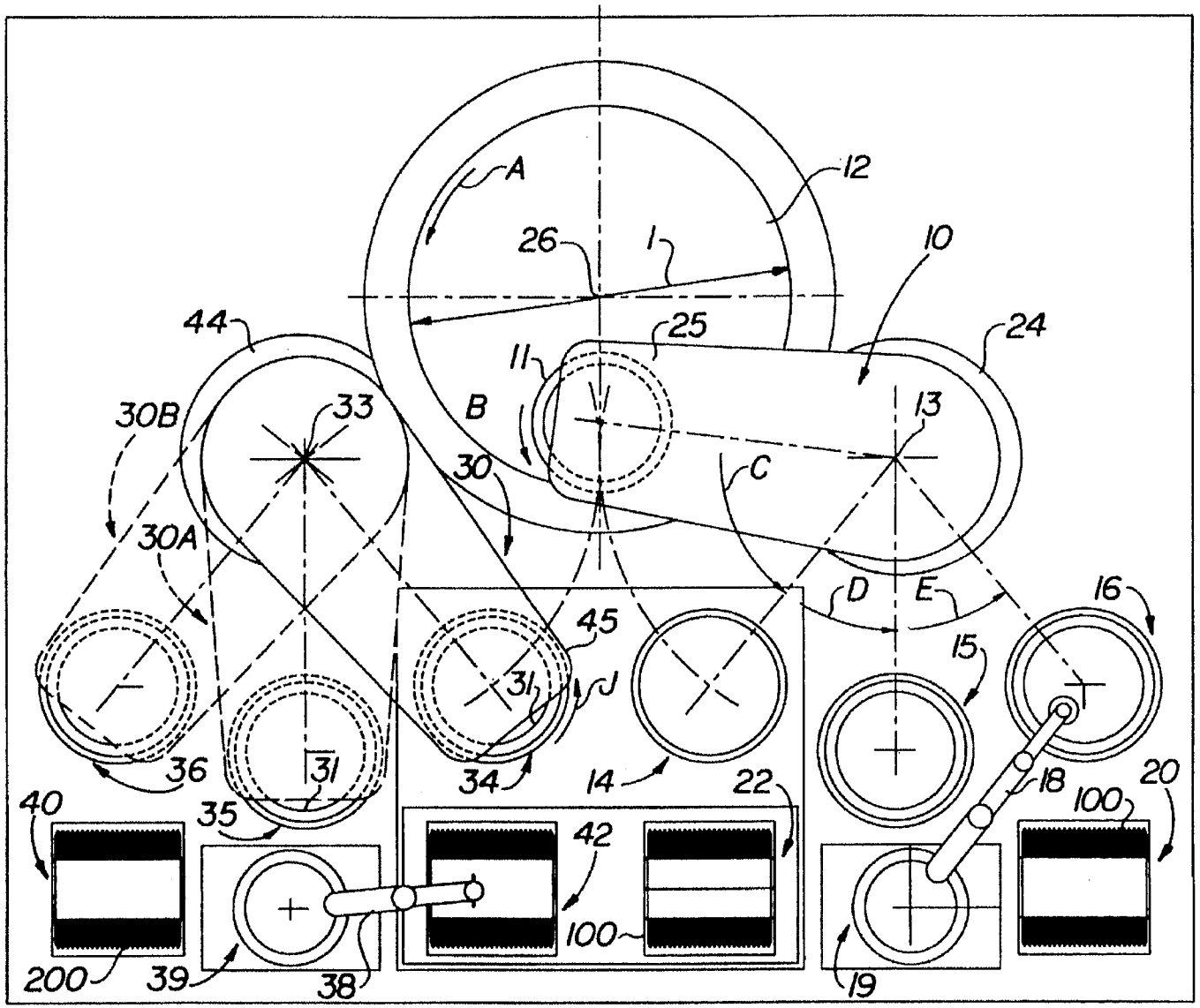
FIG. 1 is a top view of polishing apparatus constructed in accordance with the principles of the invention; and, FIG. 2 is a top view of an alternate embodiment of apparatus constructed in accordance with the invention.

Turning now to the drawings, which depict the presently preferred embodiments of the invention for the purpose of illustrating the practice thereof, and not by way of limitation of the scope of the invention, and in which like reference characters refer to corresponding elements throughout the several views, FIG. 1 illustrates polishing apparatus constructed in accordance with the principles of the invention and including a first frame 24. An elongate carrier arm 10 is pivotally attached to the frame 24 for lateral movement in the directions indicated by arrows C, D, and E. Arm 10 is also attached to frame 24 such that arm 10 can be pivotally raised and lowered in a vertical arc such that the pressure head 11 and semiconductor wafer held by head 11 can be raised and lowered with respect to the polishing surface 12. Surface 12 rotates in the direction indicated by arrow A, but can be rotated in the opposite direction. Pressure head 11 is connected to the distal end 25 of arm 10 and rotates in the direction indicated by arrow B, but can be rotated in the opposite direction. The undersurface of pressure head 11 carries a flat semiconductor wafer and maintains the wafer in contact with surface 12 and intermediate surface 12 and head 11. Arm 10 also oscillates laterally back and forth through a small arc so that the semiconductor wafer which is carried by pressure head 11 is oscillated back and forth over surface 12 when the wafer is between head 11 and surface 12. Since FIG. 1 is a top view, surface 12 and arm 10 are horizontally oriented, as are arms 30, 38, and 18.

The volumetric space extending upwardly and vertically from horizontally oriented surface 12 comprises a cylinder having a diameter equal to the diameter, indicated by arrows I, of polishing surface 12. In FIG. 1, the center line or axis of this volumetric space is perpendicular to the plane of the sheet of paper of the drawing and passes through the center point 26 of surface 12. Also, in FIG. 1, the distal end 25 and head 11 partially, and nearly completely, lie in the volumetric space above surface 12. If desired, end 25 and head 11 can lie completely in the volumetric space. A sufficient portion of end 25 and head 11 lies in the volumetric space so that wafer is normally completely over surface 12 and the entire lower flat surface of the wafer contacts polishing surface 12.

The portion of the cylindrical volumetric space above surface 12 which is occupied by end 25 and head 11 in FIG. 1 while wafer 100 is being polished on surface 12 is termed the first processing zone. A portion of end 25 and head 11 occupy and move in the first processing zone when a semiconductor wafer held by head 11 is being polished and oscillates on surface 12. When arm 10 is operated to lift arm 10 and the wafer 100 up off of surface 12 and to pivot arm to a position over cleaning station 14, end 25 and head 11 leave the processing zone. Arm 30, pressure head 31, and a wafer held on head 31 can then be pivoted from the position shown in FIG. 1 through an arc toward center point 26 until at least a portion of distal end 35 and pressure head 31 are positioned in the processing zone above surface 12. Consequently, pressure head 11 and pressure head 31 can not simultaneously occupy the processing zone.

The processing stations utilized by arm 10 include the wafer and/or pressure head cleaning station 14, the wafer unload station 15, and the wafer load station 16. Prior to being positioned over the wafer unload station, the arm 10 can position the pressure head 11 over station 14 to permit the wafer to be cleaned. Arm 10 then positions the pressure head 11 over station 15 such that the wafer can be ejected from the pressure head onto the unload station 15. Arm 18 of robot 19 is manipulated to remove the wafer from unload station 15 and place the wafer in cassette 22. Arm 18 of robot 19 is then manipulated to remove a new unpolished wafer 100 from wafer cassette 20 and load the wafer onto load station 16. Arm 10 positions the pressure head over station 14 to wash the pressure head. Arm 10 then positions the pressure head over station 16 to pick up the new unpolished wafer 100 from station 16. Cassette 22 is a conventional cassette 22 which holds a plurality of thin, circular, flat wafers 100 in parallel slots in stacked relationship. Wafer cassettes 20, 22, 40, 42 are each of equal shape and dimension. Thin circular wafers 100, 200, 300, 400 are each of equal shape and dimension. The wafer 100 is normally held on the horizontally oriented underside of pressure head 11 by a vacuum applied to the pressure head. The underside of head 11 can also be made of a substance which tends to adhere to the back of wafer 100 so that wafer 100 will not be pulled from head 11 by the force of gravity or by forces generated when wafer 100 is contacting and oscillating on surface 12 during operation of arm 10 and head 11 in the first processing zone. Pressure head 11 includes a retainer ring which also prevent lateral movement of wafer 100 with respect to head 11.

Arm 10 is pivoted about point 13 from the position shown in FIG. 1 in the direction of arrow C until head 11 is positioned over cleaning station 14. Station 14 can include means for directing streams of water, gas or other fluids against the head 11 and wafer. Arm 10 is moved in the direction of arrow D to move head 11 from over processing station 14 into position over processing station 15. Arm 10 is moved in the direction of arrow E to move head 11 from over processing station 15 into position over processing station 16. As would be appreciated by those skilled in the art, the sequence of movements of arm 10 between the processing stations 14 to 16 and/or the polishing surface 12 can be varied as desired.

Elongate carrier arm 30 is pivotally attached to the frame 44 for lateral movement between surface 12 and processing stations 34, 35, and 36. Arm 30 is also attached to frame 44 such that arm 30 can be pivotally raised and lowered in a vertical arc such that the pressure head 31 and semiconductor wafer held by head 31 can be raised and lowered with respect to the polishing surface 12. Pressure head 31 is connected to the distal end 45 of arm 30 and rotates in the direction indicated by arrow J, or can be rotated in the opposite direction. Pressure head 31 carries a flat circular semiconductor wafer 200 and maintains the wafer 200 in contact with surface 12 and between surface 12 and head 31. Arm 30 also oscillates laterally back and forth through a small arc so that the semiconductor wafer which is carried by pressure head 31 can be oscillated back and forth over surface 12 when the wafer 200 is intermediate head 31 and surface 12.

When arm 10 is operated to lift arm 10 and the wafer up off of surface 12 and to pivot arm to a position over cleaning station 14, end 25 and head 11 leave the first processing zone above surface 12. Arm 30, pressure head 31, and a wafer 200 held on head 31 can then be pivoted from the position shown in FIG. 1 through a horizontal arc toward center point 26 until at least a portion of distal end 35 and pressure head 31 are positioned in the first processing zone. Consequently, pressure head 11 and pressure head 31 can not simultaneously occupy the first processing zone. Arm 30 is then pivoted vertically downwardly a short distance to contact wafer 200 with surface 12.

The processing stations utilized by arm 30 include the wafer and/or pressure head cleaning station 34, the wafer unload station 35, and the wafer load station 36. Prior to being positioned over the wafer unload station, the arm 30 can position the pressure head 31 over station 34 to permit the wafer to be cleaned. Arm 30 then positions the pressure head 31 over station 35 such that the wafer can be ejected from the pressure head onto the unload station 35. Arm 38 of robot 39 is manipulated to remove the wafer from unload station 35 and place the wafer in cassette 42. Arm 38 of robot 39 is then manipulated to remove a new unpolished wafer 200 from wafer cassette 40 and load the wafer onto load station 36. Arm 30 positions the pressure head over station 34 to wash the pressure head. Arm 30 then positions the pressure head over station 36 to pick up the new unpolished wafer 200 from station 26. The wafer 200 is normally held on the horizontally oriented underside of pressure head 31 by a vacuum applied to the pressure head. The underside of head 31 can also be made of a substance which tends to adhere to the back of wafer 200 so that wafer 200 will not be pulled from head 31 by the force of gravity or by forces generated when wafer 200 is contacting and oscillating on surface 32 during operation of arm 30 and head 31 in the first processing zone. Pressure head 31 includes a retainer ring which also prevent lateral movement of wafer 200 with respect to head 31. Any desired prior art means can be used to supplement or replace robots 39 and 19 and to load and unload wafers from pressure heads 11 and 31. As would be appreciated by those skilled in the art, the sequence of movements of arm 10 between the processing stations 14 to 16 and/or the polishing surface 12 can be varied as desired.

As noted, arm 30 can be pivoted through a horizontally oriented arc and to the left in FIG. 1 to move head 31 from its position shown in FIG. 1 over processing station 34 to a new position, indicated by dashed lines 30A, over the unload processing station 35. After head 31 is positioned over the unload processing station 35, arm 30 can be pivoted about point 33 through a horizontally oriented arc to the left in FIG. 1 to move head 31 from a position over station 35 to a new position, indicated by dashed lines 30B, over the load station 36. When arm 10 is pivoted such that pressure head 11 is positioned over one of processing stations 14, 15, 16, then in FIG. 1 arm 30 can be pivoted to the right through a horizontally oriented arc to move head 31 from a position over the load station 36 (or from a position over one of the other processing stations 34, 36) and into the processing zone over surface 12 so that the lower surface of a circular flat wafer 200 held by head 31 can be contacted with polishing surface 12. The upper or back surface of wafer 200 is, of course, held against the lower or under surface of head 31.

Figure 2:
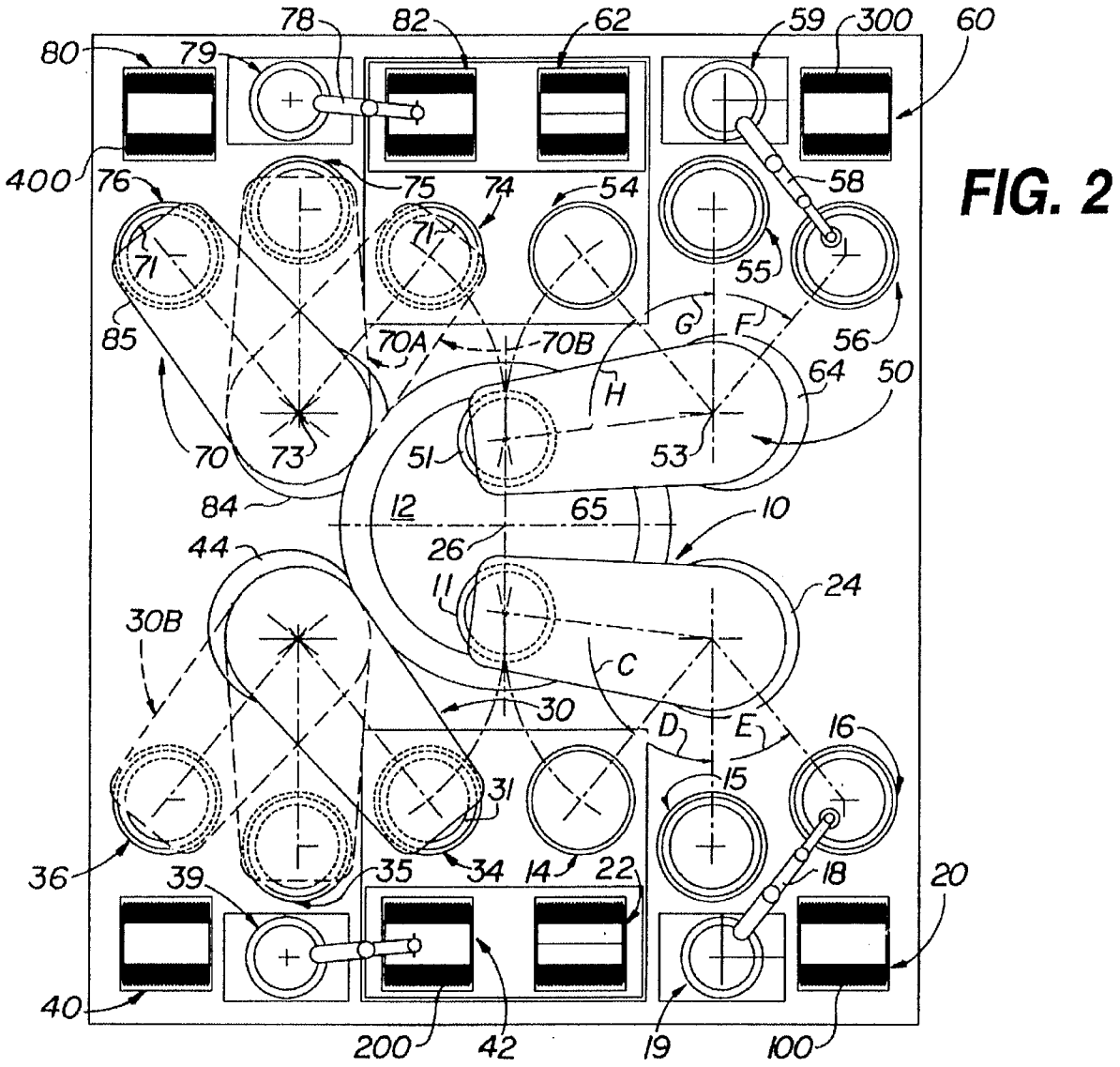

The carrier arms 10 and 30, processing stations 14 to 16 and 34 to 36, robots 19 and 39, wafer cassettes 40 and 42 and 20 and 22, and polishing surface 12 of FIG. 1 are utilized in the polishing apparatus of FIG. 2. In FIG. 2, another pair of polishing arms 50 and 70 and of associated processing stations are provided in order to substantially continuously maintain a wafer against the other side of surface 12 while arms 10 and 30 substantially continuously maintain a semiconductor wafer in a second processing zone against surface 12.

Elongate carrier arm 50 is pivotally attached to the frame 64 for lateral movement between surface 12 and processing stations 54, 55, and 56. Arm 50 is also attached to frame 64 such that arm 50 can be pivotally raised and lowered in a vertical arc so that the pressure head 51 and semiconductor wafer 300 held by head 51 can be raised and lowered with respect to the polishing surface 12. Pressure head 51 is connected to the distal end 65 of arm 50 and rotates. Pressure head 51 carries a flat circular semiconductor wafer 300 and can maintain the wafer 300 in contact with surface 12 and intermediate surface 12 and head 51 when pressure head 31 and end 65 are in the second processing zone. Arm 50 also oscillates laterally back and forth through a small arc so that the semiconductor wafer 300 which is carried by pressure head 51 can be oscillated back and forth over surface 12 when the wafer 300 is intermediate head 51 and surface 12 and is contacting surface 12.

As earlier noted, the volumetric space extending from surface 12 upwardly comprises a cylinder having a diameter equal to the diameter, indicated by arrows I, of polishing surface 12. In FIG. 2, the center line or axis of this volumetric space is perpendicular to the plane of the sheet of paper of the drawing and passes through the center point 26 of surface 12. Also, in FIG. 2, the distal end 65 and head 51 partially lie in the volumetric space above surface 12. If desired, end 65 and head 51 can lie completely in the volumetric space. Sufficient portions of end 65 and head 51 lie in the volumetric space so that wafer 300 is normally completely over surface 12 so that the entire lower flat surface of the wafer contacts polishing surface 12.

The volume occupied by end 65 and head 51 in FIG. 2 is called the second processing zone. The second processing zone is separate from the first processing zone. A portion (nearly all) of end 65 and head 51 occupy the second processing zone when a semiconductor wafer held by head 51 contacts and is being polished on surface 12. When arm 50 is operated to lift arm 50 and the wafer up off of surface 12 and to pivot arm 50 about point 53 to a position over cleaning station 54, end 65 and head 51 leave the second processing zone. Arm 70, pressure head 71, and a wafer 400 held on head 71 can then be pivoted about point 73 from the position shown in FIG. 2 through a horizontally oriented arc toward center point 26 until at least a portion of distal end 85 and pressure head 71 are positioned in the second processing zone above surface 12. Consequently, pressure head 51 and pressure head 71 can not simultaneously occupy the second processing zone.

The processing stations utilized by arm 50 include the wafer and/or pressure head cleaning station 54, the wafer unload station 55, and the wafer load station 56. Arm 58 of robot 59 is manipulated to unload a wafer 300 from head 51 positioned over station 55 and to put the wafer 300 into wafer cassette 62. Arm 58 of robot 59 is manipulated to remove a wafer 300 from cassette 60 and load the wafer on the underside of pressure head 51 positioned over station 56. The wafer 300 is normally held on the horizontally oriented underside of pressure head 51 by a vacuum applied to the pressure head. The underside of head 51 can also be made of a substance which tends to adhere to the back of wafer 300 so that wafer 300 will not be pulled from head 51 by the force of gravity or by forces generated when wafer 300 is contacting and oscillating on surface 12 during operation of arm 50 and head 51. Any desired prior art means can be used to supplement or replace robots 59 and 79 and to load and unload wafers from pressure heads 51 and 71.

Arm 50 is pivoted about point 53 from the position shown in FIG. 2 in the direction of arrow H until head 51 is positioned over cleaning station 54. Station 54 can include means for directing streams of water, gas or other fluid against the head 51 and wafer 300. Arm 50 is moved in the direction of arrow G to move head 51 from over processing station 54 into position over processing station 55. Arm 50 is moved in the direction of arrow F to move head 51 from over processing station 55 into position over processing station 56.

Arm 70 is pivoted through a horizontally oriented arc and to the right to move head 71 from its position shown in FIG. 2 over the load processing station 76 to a new position, indicated by dashed lines 70A, over the unload processing station 75. Once head 71 is positioned over the unload processing station 75, arm 70 is pivoted about point 73 through a horizontally oriented arc to the right in FIG. 2 to move head 71 from a position over station 75 to a new position, indicated by dashed lines 70B, over the cleaning processing station 74. When arm 50 is pivoted such that pressure head 51 is positioned over one of processing stations 54, 55, 56, then in FIG. 2 arm 70 can be pivoted to the right through a horizontally oriented arc to move head 71 from a position over one of stations 74 to 76 and into the second processing zone over surface 12 so that the lower surface of a circular flat wafer 400 held by head 71 can be contacted with polishing surface 12. The upper or back surface of wafer 400 is, of course, held against the lower surface of head 71.

In operation of the polishing apparatus of FIG. 1, arm 10 is pivoted through a horizontal arc to position pressure head 11 over load station 16. Robot 19 is utilized to load a wafer 100 from cassette 20 onto load station 16. Pressure head 11 picks up the wafer from load station 16. Arm 10 is pivoted through a horizontal arc to the position shown in FIG. 1 with head 11 over surface 12. Arm 10 is pivoted a short distance downwardly through a vertical arc to contact surface 12 with wafer 100. A colloidal aqueous slurry or other slurry is applied to surface 12. Surface 12 is rotated in the direction of arrow A. Head 11 is rotated in the direction of arrow B, but can be rotated in the opposite direction. Arm 10 is oscillated through a small horizontally oriented arc to oscillate wafer 100 over surface 12.

Meanwhile, arm 30 is pivoted about point 33 through a horizontally oriented axis to position pressure head 31 over unload station 36. The wafer held on head 31 is ejected into station 36. The wafer is loaded into cassette 42 by the robot arm 38. Arm 30 pivots about point 33 to position pressure head 31 over load station 35. Robot 39 loads a wafer 200 from cassette 40 onto station 35. Pressure head 31 picks up the wafer 200 from station 35.

After a selected period of time, arm 10 is lifted a short distance upwardly away from surface 12 and is pivoted about point 13 laterally through a horizontally oriented plane to position pressure head 11 over cleaning station 14. As soon as head 11 is over station 14, arm 30 is pivoted about point 33 in a direction to the right in FIG. 1 until head 31 is at least partially in the first processing zone which was occupied by head 11 when head 11 was in the position illustrated in FIG. 1. Arm 30 is pivoted downwardly a short distance to contact the wafer 200 with the polishing surface 12 and with a slurry on surface 12. Consequently, as will be appreciated by those of skill in the art, the apparatus of FIG. 1 (and of FIG. 2) permits a wafer to be maintained on a pressure head in a selected processing zone nearly continuously, making efficient use of polishing surface 12.

Arms 50 and 70 are operated in a manner similar to that described above for arms 10 and 30.

Figure 3:
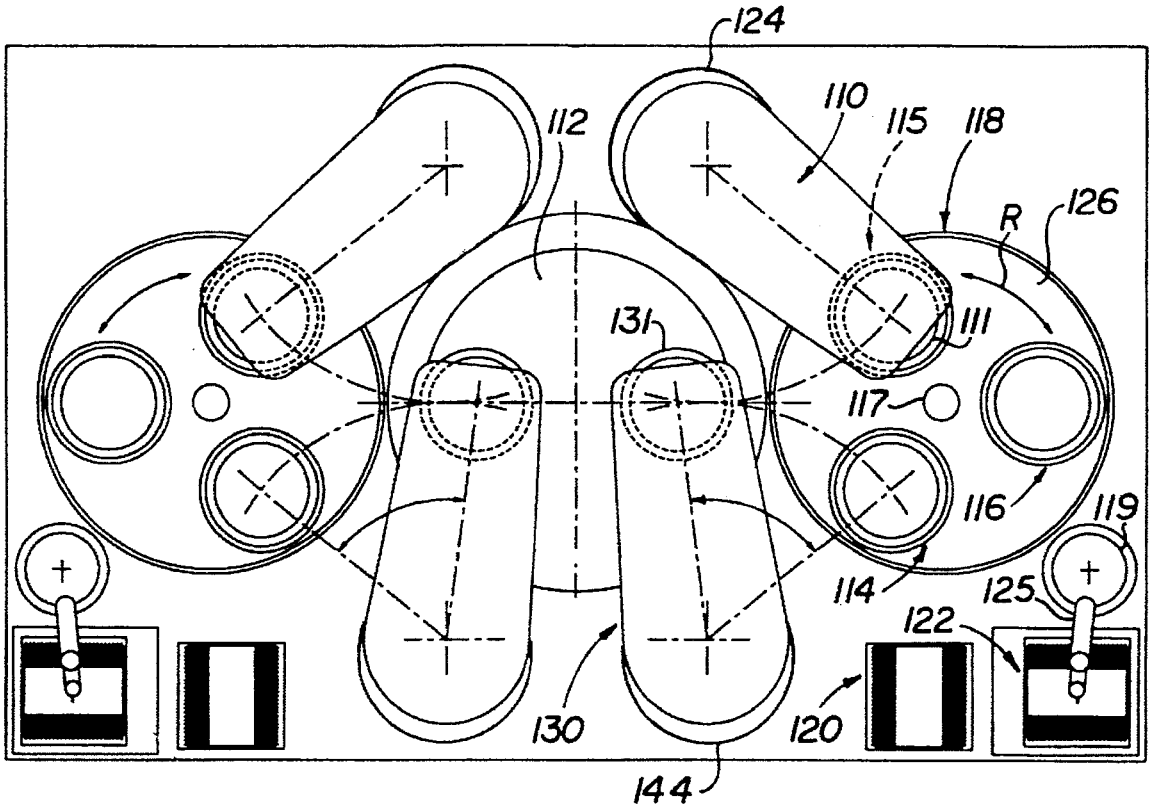
FIG. 3 is a top view of a third embodiment of apparatus constructed in accordance with the invention.

The polishing apparatus of FIG. 3 includes a first frame 124 resting on the ground. Elongate carrier arm 110 is identical to carrier arm 10 in FIG. 1 and is pivotally attached to the top of frame 124 for lateral movement (i.e., movement in directions parallel to the plane of the sheet of paper of the drawings on which FIG. 3 is depicted) between the position of arm 110 in FIG. 3 and a second position in which the pressure head 111 is positioned over polishing surface 112. The proximate end of arm 110 is pivotally attached to frame 124 such that arm 110 can be pivotally raised and lowered through a vertical arc such that the pressure head 111 and semiconductor wafer held by head 111 can be vertically raised away from and lowered onto the polishing surface 112. Surface 112 rotates in the same manner as surface 12 in FIG. 1. Pressure head 111 is connected to the distal end of arm 110 and rotates in a direction comparable to that of head 11 in FIG. 1. The undersurface or pressure head 111 typically carries a flat semiconductor wafer and maintains the wafer in contact with surface 112 and head 111. Arm 110 also oscillates laterally back and forth through a small arc so that head 111 and the semiconductor wafer which is carried by head 111 are oscillated back and forth over surface 112 when the wafer is between head 111 and surface 112. Since FIG. 3 is a top view, surface 112 and arm 110 are generally horizontally oriented, as are arms 130 and 125.

Elongate carrier arm 130 is pivotally attached to the frame 144 for lateral movement between the position of arm 130 shown in FIG. 3 and a second position with the pressure head 131 positioned over a wafer polishing station 114 to 115 positioned at the seven o'clock location of station 114 in FIG. 3. The proximate end of arm 130 is attached to frame 144 such that arm 30 can be pivotally raised and lowered through a vertical arc such that the pressure head 131 and semiconductor wafer held by head 131 can be raised away from and lowered onto polishing surface 112. Pressure head 131 is connected to the distal end of arm 130 and is rotated in a manner similar to pressure head 31 in FIG. 1. Pressure head 131 typically carries a flat circular semiconductor wafer and maintains the wafer in contact with surface 112 and between surface 112 and head 131. Arm 130 also oscillates laterally (i.e., oscillates in directions parallel to the plane of the sheet of paper of the drawings on which FIG. 3 is depicted.) back and forth through a small arc so that head 131 and the semiconductor wafer which is carried by head 131 can be oscillated back and forth over surface 112 when the wafer is intermediate head 131 and surface 112.

A triad of wafer processing stations 114, 115, 116 are mounted on the generally horizontal flat circular upper surface 126 of table 118. Table 118 and surface 126 rotate about and are indexed about the vertical longitudinal axis of spindle 117 in the directions indicated by arrows R in FIG. 3. The triad of wafer processing stations include wafer and/or pressure head cleaning station 114, wafer unload station 115, and wafer load station 116. Any of a number of well known apparatus or methods can be utilized to control the rotation and indexing of table 118 about the longitudinal axis of spindle 117 in the directions indicated by arrows R. The table 118 can, for example, be manually turned like a daisy wheel or can be mechanically controlled. In FIG. 3 station 116 is in a first operative position, termed, for sake of convenience, the "three o'clock position". In FIG. 3, station 114 is in a second operative position, termed the "seven o'clock position". The position of station 115 in FIG. 3 is the third operative position, termed the "eleven o'clock position". During utilization of the apparatus of FIG. 3, each station 114, 115, 116 is normally positioned at the three o'clock, seven o'clock, or eleven o'clock position. When, for example, in FIG. 3 one of the wafer processing stations 114 to 116 and/or head 111 is at the eleven o'clock position, it is at one wafer processing location. When station 114 and/or any wafer processing station is at the seven o'clock position, it is at a second wafer processing location. The eleven o'clock position is one wafer processing location. The seven o'clock position is a second wafer processing location. The three o'clock position is a third wafer processing location. Each of stations 114 to 116 can be indexed to the third (or first or second) wafer processing location. In the apparatus shown in FIG. 3, heads 111 and 131 are never positioned at the third wafer processing location, although arms 110 and 130 could be made in a telescoping configuration which would permit the positioning of heads 111 and 131 at the third wafer processing location.

Circular unpolished semiconductor wafers are stored in cassette 120. Circular polished semiconductor wafers are stored in cassette 122. Cassette 122 is presently stored in a reservoir such that the wafers in cassette 122 are submerged.

Robot 119 is operated such that arm 125 can remove wafers from cassette 120 and place them on load station 116 and such that arm 125 can remove polished wafers from station 115 and insert the wafers in cassette 122.

In operation of the apparatus of FIG. 3, arm 130 and head 131 oscillate a wafer over surface 112 to polish the wafer. While head 131 is polishing a wafer on surface 112, arm 110 and head 111 are in the position shown in FIG. 3 and are unloading a polished wafer onto unload station 115. After the wafer is unloaded from head 111 onto station 115, arm 110 is (if necessary) operated (either manually, or mechanically) to vertically lift head 111 a selected distance (typically a couple of inches) upwardly away from station 115 so that table 118 can be indexed in a clockwise direction in FIG. 3 to move station 115 to the three o'clock position. When station 115 is in the three o'clock position, station 116 is in the seven o'clock position and station 114 is in the eleven o'clock position. Stations 114 to 116 move simultaneously. When table 118 is indexed, each station 114 to 116 presently moves an identical distance along a common circular path of travel. When station 115 is in the three o'clock position, arm 125 of robot 119 is utilized to remove the polished wafer from station 115 and insert the wafer in cassette 122. The table 118 is then indexed to return station 116 to the three o'clock position where arm 125 of robot 119 is utilized to remove an unpolished wafer from cassette 120 and to place the unpolished wafer on station 116. After the unpolished wafer is positioned on station 116, table 118 is indexed to move station 116 to the eleven o'clock position. When station 116 is in the eleven o'clock position, the unpolished wafer on station 116 is loaded onto head 111 by lowering arm 110 through a vertical arc such that head 111 can pick up the unpolished wafer from station 116; or, arm 110 is not lowered and station 116 instead lifts the unpolished wafer into position against head 111; or, arm 110 is lowered and station 116 simultaneously also lifts the unpolished wafer toward head 111; etc. Once the unpolished wafer is loaded on head 111, arm 110 is, if necessary, moved upwardly to clear head 111 upwardly away from station 116 and table 118 is indexed to move the cleaning station 114 to the eleven o'clock position. When the cleaning station 114 is at the eleven o'clock position, pressurized air, water, and/or gas streams or any other desired methods are used to clean the head 111 and the unpolished wafer held on head 111. As is well known, the unpolished wafer is typically held on head 111 by a vacuum which suctions the unpolished wafer against the head.

After station 114 completes the cleaning of the unpolished wafer, arm 110 is, if necessary, lifted to move head away from station 114, and table 118 is indexed to move station 114 to the seven o'clock position. When the polishing of the wafer on head 131 is completed, arm 130 is operated to lift head 131 up away from surface 112, after which arm 130 is laterally pivoted to move the head 131 to a position directly above and over station 114, i.e., to move head 131 to the seven o'clock wafer processing location. As soon as head 131 is moved away from surface 112, arm 110 is operated to laterally move arm 110 and head 111 from the eleven o'clock wafer processing location to a position over surface 112 and to downwardly displace head 111 to contact the unpolished wafer on head 111 with surface 112 and polishing media on rotating surface 112. While head 111 is maintaining a wafer in position against polishing surface 112, station 114 cleans head 131 and the polished wafer carried on head 131. After head 131 is cleaned, arm 110 and head 115 are, if necessary, lifted to move head 131 away from station 114. Table 118 is indexed to move the unload station 115 to the seven o'clock position beneath head 131. The wafer on head 131 is unloaded onto station 115; station 115 is indexed to the three o'clock position; arm 125 removes the polished wafer from station 115 and stores the wafer in cassette 122; and, head 131 is loaded with a new unpolished wafer in the manner described above for head 111 so that head 131 is ready to be moved back over polishing surface 112 when polishing of the wafer on head 111 is complete and head 111 is moved from over surface 112 to a position over a station 115 at the eleven o'clock wafer processing location. As would be appreciated by those of skill in the art, the particular sequence of positioning stations 114, 115 116 can be varied as desired. For example, it might be desirable to clean a head 111 before and after a polished wafer carried by head 111 is removed. A primary purpose of the apparatus of FIG. 3 is, however, to permit a plurality of wafer processing stations 114 to 116 to be indexed into and out of the seven o'clock and eleven o'clock positions (or any other specific selected wafer processing locations) to facilitate the simultaneous processing of wafers by heads 131 and 111.

FIG. 3 also illustrates in mirror image to arms 110, 130, table 118, etc. another set of polishing apparatus which can be utilized in conjunction with surface 112 and which is identical to arms 110, 130, table 118, robot 119 and wafer storage cassettes 120 and 122.

Having described my invention in such terms as to enable those skilled in the art to understand and practice it, and having identified the presently preferred embodiments thereof, I claim:

1. Apparatus for polishing thin wafers of a material, comprising (a) polishing surface means for polishing wafers;

(b) a first frame;

(c) first carrier means pivotally mounted on said frame and including a distal end;

(d) a first pressure head mounted on said distal end of said carrier means for carrying a first wafer and for maintaining the first wafer in contact therewith and against said polishing surface means;

(e) a first wafer processing location separate from said polishing surface means, said carrier means being movable between at least two operative positions, (i) a first operative position with said pressure head positioned adjacent said first processing location, and (ii) a second operative position with said first carrier means moved from said first operative position to said second operative position, and said pressure head positioned over said polishing surface means;

(f) a second frame;

(g) second carrier means pivotally mounted on said second frame and including a distal end;

(h) a second pressure head mounted on said distal end of said second carrier means for carrying a second wafer and for maintaining the second wafer in contact therewith and against said polishing surface means;

(i) a second wafer processing location separate from said first wafer processing location and from said polishing surface means, said second carrier means being movable between at least two operative positions, (i) an initial operative position with said second pressure head positioned adjacent said second processing location, and (ii) a secondary operative position with said second carrier means moved from said initial operative position to said secondary operative position, and said second pressure head positioned over said polishing surface means, and; and, (j) a plurality of wafer processing stations separate from said polishing surface means and each indexable between said first and second wafer processing locations, each of said stations being able to process wafers on only one of said first and second pressure heads at a time when said station is at one of said first and second wafer processing locations.

2. The apparatus of claim 1 wherein said wafer processing stations include at least one cleaning station.

3. The apparatus of claim 1 wherein said wafer processing stations include at least one wafer load station.

4. The apparatus of claim 1 wherein said wafer processing stations include at least one wafer unload station.

5. The apparatus of claim 1 wherein said wafer processing stations are selected from the group consisting of wafer cleaning stations, pressure head cleaning stations, wafer load stations, and wafer unload stations.

6. The apparatus of claim 1 wherein (a) said first carrier means is unable to be positioned adjacent said second wafer processing location; and, (b) said second carrier means is unable to be positioned adjacent said first wafer processing location.

7. The apparatus of claim 1 wherein the second wafer can be processed by one of said processing stations only when said first carrier means is in said second operative position.

8. The apparatus of claim 1 wherein the first wafer can be processed by one of said processing stations only when said second carrier means is in said secondary operative position.

9. Apparatus for polishing thin wafers of a material, comprising (a) polishing surface means for polishing wafers;

(b) a first frame;

(c) first carrier means pivotally mounted on said frame and including a distal end;

(d) a first pressure head mounted on said distal end of said carrier means for carrying a first wafer and for maintaining the first wafer in contact therewith and against said polishing surface means;

(e) a first wafer processing location separate from said polishing surface means, said carrier means being movable between at least two operative positions, (i) a first operative position with said pressure head positioned adjacent said first processing location, and (ii) a second operative position with said first carrier means moved from said first operative position to said second operative position, said pressure head positioned over said polishing surface and maintaining said first wafer against and contacting said polishing surface means, and said pressure head and said distal end occupying a selected processing zone above said polishing surface means;

(f) a second frame;

(g) second carrier means pivotally mounted on said second frame and including a distal end;

(h) a second pressure head mounted on said distal end of said second carrier means for carrying a second wafer and for maintaining the second wafer in contact therewith and against said polishing surface means;

(i) a second wafer processing location separate from said first wafer processing location and from said polishing surface means, said second carrier means being movable between at least two operative positions, (i) an initial operative position with said second pressure head positioned adjacent said second processing location, and (ii) a secondary operative position with said second carrier means moved from said initial operative position to said secondary operative position, said second pressure head positioned over said polishing surface means and maintaining said second wafer against and contacting said polishing surface means when said first carrier means is in said first operative position, and said second pressure head and said distal end of said second carrier means occupying at least a portion of said selected processing zone above said polishing surface means; and, (j) a plurality of wafer processing stations separate from said polishing surface means and each indexable between said first and second wafer processing locations, each of said stations being able to process wafers on only one of said first and second pressure heads at a time when each of said stations is at one of said first and second wafer processing locations, said second carrier means being movable to said secondary operative position only when said first carrier means is positioned in said first operative position with said first pressure head moved out of said selected processing zone.

10. Apparatus for polishing thin wafers of a material, comprising (a) polishing surface means for polishing wafers;

(b) a first frame;

(c) first carrier means pivotally mounted on said frame and including a distal end;

(d) a first pressure head mounted on said distal end of said carrier means for carrying a first wafer and for maintaining the first wafer in contact therewith and against said polishing surface means;

(e) a first wafer processing location separate from said polishing surface means, said carrier means being movable between at least two operative positions, (i) a first operative position with said pressure head positioned adjacent said first processing location, and (ii) a second operative position with said first carrier means moved from said first operative position to said second operative position, said pressure head positioned over said polishing surface and maintaining said first wafer against and contacting said polishing surface means, and said pressure head and said distal end occupying a selected processing zone above said polishing surface means;

(f) a second wafer processing location separate from said first wafer processing location and from said polishing surface means; and, (g) a plurality of wafer processing stations separate from said polishing surface means and each indexable between said first and second wafer processing locations, each of said stations being able to process wafers on said first pressure heads when each of said stations is at said first wafer processing location.

* * * * *